US008298347B2

(12) United States Patent
MacNeil et al.

(10) Patent No.: US 8,298,347 B2
(45) Date of Patent: Oct. 30, 2012

(54) METHOD AND APPARATUS FOR CLEANING A SUBSTANTIALLY VERTICAL SURFACE

(75) Inventors: Gerard J. MacNeil, Surrey (CA); Gordon W. MacNeil, Delta (CA); David B. MacNeil, Langley (CA); Vernon Bose, Langley (CA)

(73) Assignee: Mac & Mac Hydrodemolition Inc., Surrey (CA)

( * ) Notice: Subject to any disclaimer, the term of this patent is extended or adjusted under 35 U.S.C. 154(b) by 422 days.

(21) Appl. No.: 12/677,210

(22) PCT Filed: Aug. 6, 2008

(86) PCT No.: PCT/CA2008/001432

§ 371 (c)(1), (2), (4) Date: Mar. 9, 2010

(87) PCT Pub. No.: WO2009/033257

PCT Pub. Date: Mar. 19, 2009

(65) Prior Publication Data

US 2010/0206333 A1 Aug. 19, 2010

(30) Foreign Application Priority Data

Sep. 11, 2007 (CA) ..... 2601493
Oct. 5, 2007 (CA) ..... 2605826

(51) Int. Cl.
*B08B 3/02* (2006.01)
*A47L 1/00* (2006.01)
*A47L 11/00* (2006.01)

(52) U.S. Cl. ..... 134/34; 134/24; 134/42; 134/172; 134/198; 134/199

(58) Field of Classification Search ..... 134/18, 134/24, 34, 42, 172, 179, 198, 199; 15/49.1, 15/103

See application file for complete search history.

(56) References Cited

U.S. PATENT DOCUMENTS

| | | | | |
|---|---|---|---|---|
| 3,750,686 | A * | 8/1973 | Cook | 134/95.3 |
| 4,470,952 | A | 9/1984 | Vassalotti | |
| 4,646,769 | A | 3/1987 | O'Brien | |
| 4,809,384 | A | 3/1989 | Yokata | |
| 5,020,183 | A | 6/1991 | Grant | |
| 5,240,503 | A * | 8/1993 | Levy et al. | 118/323 |
| 5,381,811 | A | 1/1995 | Boisture | |
| 5,890,250 | A | 4/1999 | Lange | |
| RE36,649 | E * | 4/2000 | Jefferies et al. | 15/50.1 |
| 6,050,277 | A | 4/2000 | Purton | |
| 6,615,434 | B1 | 9/2003 | Davis | |

FOREIGN PATENT DOCUMENTS

JP 2005024191 1/2005

* cited by examiner

*Primary Examiner* — Saeed T Chaudhry

(57) ABSTRACT

A method of and apparatus for cleaning a surface, such as a wall of a waste boiler of a Kivcet furnace, are described. The invention comprises suspending a pair of spaced apart cables adjacent a surface to be cleaned, attaching ends of the rail to respective ones of the cables with equal lengths of cable between the rail and the roof, the rail being reversibly moveable up and down the surface. A carriage has a nozzle assembly, operative to emit a jet of water, with the carriage reversibly moveable along the rail. The rail is moved from one of a top and bottom of the surface to another of the top and bottom of the surface, and the carriage is moved from one side of the rail to another, cleaning the surface as it moves. The foregoing steps are repeated for each remaining uncleaned surface.

6 Claims, 5 Drawing Sheets

METHOD AND APPARATUS FOR CLEANING A SUBSTANTIALLY VERTICAL SURFACE

FIELD

The present application relates to a method for remotely cleaning a radiant boiler of a furnace and other substantially vertical surfaces.

BACKGROUND

Referring to FIG. 1 one type of smelter has a reaction shaft 10 into which feed material is inserted together with oxygen and the fluxing agents silica and limestone. The mixture ignites instantaneously to form hot sulphur dioxide gas and the lead, zinc, iron and other metals form metal oxides. The resulting semi-fused slag falls to the bottom of the first compartment along with the coarse coke. The dry feed is injected at the top of a reaction shaft of the smelter together with oxygen. The coke collects as a surface layer, called a "coke checker", floating on top of the molten slag. When the metal oxides percolate through this layer of burning coke, they are reduced and the lead is converted to metal as bullion.

The bullion continues to settle through the molten slag layer beneath the coke checker. Together with the zinc-bearing iron slag, the bullion passes under a partition wall into a compartment, which is an electric furnace. This partition wall extends into the molten slag forcing the hot sulphur dioxide gas to pass through a waste heat boiler and onto an electrostatic precipitator rather than into the electric furnace compartment The metallic slag containing ail of the iron and most of the zinc from a furnace is transferred in 70 tonne batches to a coal-fired fuming furnace 12. To recover the zinc, fine coal and air are injected one meter below the top of the slag bath. The heat generated causes the zinc to fume as a vapour from the furnace bath and is immediately reoxidized by tertiary air above the bath to form zinc oxide fume. These fumes and hot gases are cooled in a waste heat boiler 14 before passing through a baghouse to collect the zinc fumes for treatment in an adjacent Fume Leach Plant (not shown). The waste heat boiler 14, see FIG. 2, consists of a room having a plurality of closely spaced vertical pipes 16 against the surfaces 18. Water runs through these pipes 16 picking up heat from the gases inside and exiting as hot water or steam. In time deposits form over the exterior of the pipes, reducing their effectiveness in cooling the gases.

SUMMARY OF THE INVENTION

According to the invention there is provided a method and apparatus for directing high pressure fluid against a substantially vertical surface for the purpose of cleaning or scarifying the surface. The surface may be, for instance, a wall, or cooling pipes, plates, or other structures attached to a wall. Such surfaces include, by way of example, the wall of a cooling tower and vertical cooling pipes of a radiant boiler of a furnace. The term "surface" is used herein to refer to the area of structures to which high pressure fluid can be effectively and advantageously applied.

The apparatus comprises a robot suspended from cables adjacent to the surface and operable to move back and forth across the surface area. The robot comprises one or more nozzles in communication with a source of high-pressure fluid, normally water. As the robot moves back and forth across the surface, a high-pressure jet of fluid is emitted from the nozzles against the surface, producing a substantially horizontal swath of cleaned or scarified surface. The apparatus also comprises means for raising and lowering the robot along the surface. When a first swath has been completed, the robot is raised or lowered and a subsequent swath is produced in a like manner as the first. The apparatus is then moved to another uncleaned wall of the waste boiler and cleans or scarifies that wall. The waste water and removed material produced by the operation is collected and transferred to a waste tank. The word "cleans or cleaning" is used herein to include scarifying a surface and removing deposits built up on a surface.

The method of the invention includes a mounting step by which a pair of cables is suspended vertically adjacent the surface. Ends of t the robot are attached to respective ones of the cables, the robot being moveable up and down the surface either by crawling along the cables or by means of the cables being raised and lowered.

The robot may comprise an elongated rail suspended at either end from the cables. A carriage containing at least one nozzle is mounted on the rail, with the carriage being moveable back and forth along the rail. A high pressure water line is coupled to the nozzle so that the nozzle is operative to emit a jet of water against the surface when the water line is opened, thereby producing a swath cleaned surface as the nozzle is moved to and fro across the surface. The rail is repeatedly moved up or down the surface along the cables, and the carriage is moved back and forth on the rail, thus cleaning the wall from top to bottom or for bottom to top. The foregoing steps are repeated for each remaining uncleaned wall.

The cable is optionally wound on drums, the drums being rotatable in response to control signals from a user.

The cables are optionally attached by its upper end to a fixed point and the rail ends are attached to the cables by a gear system that allows the rail to crawl up and down the cable.

In one embodiment of the invention there is provided a method of cleaning a waste boiler of a furnace, which method comprises suspending a pair of spaced apart cables down from a roof of the waste boiler, adjacent an interior surface to be cleaned, attaching ends of the rail to respective ones of the cables with equal lengths of cable between the rail and the roof, the rail being reversibly moveable up and down the wall. A carriage with a pair of nozzles, one above another on the rail, is reversibly moved along the rail. High-pressure water lines are coupled to the nozzles, with the nozzles operative to emit jets of water against the surface when the water lines are opened. The rail is moved from one of a top and bottom of the surface to another of the top and bottom of the surface, and the carriage is moved from one side of the rail to the other, cleaning the surface as it moves. The foregoing steps are repeated for each remaining uncleaned surface.

Advantageously, the cable is wound on drums supported by the boiler roof and the drums are rotatable in response to control signals from a user. The cable may be affixed to the roof and attached to a gear system at the rail which allows the rail to crawl up and down the cable. Preferably, the rail commences operation at a top of the wall and moves downwardly.

A lower pressure may be applied to the surface first and a great pressure next. In the case of the rail commencing operation at a top of the wall, the ultra high pressure nozzle is on the top and the high pressure nozzle is below. A waste line is coupled at one end to a floor of the waste boiler and at another end to a waste tank and is operative to drain waste from the waste boiler to the waste tank.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

In the following, "high pressure water jetting" shall mean cleaning performed at pressures between 10,000 to 25,000 psi while "ultra high pressure water jetting" shall mean cleaning performed at pressures greater than 25,000 psi.

Figure 1:
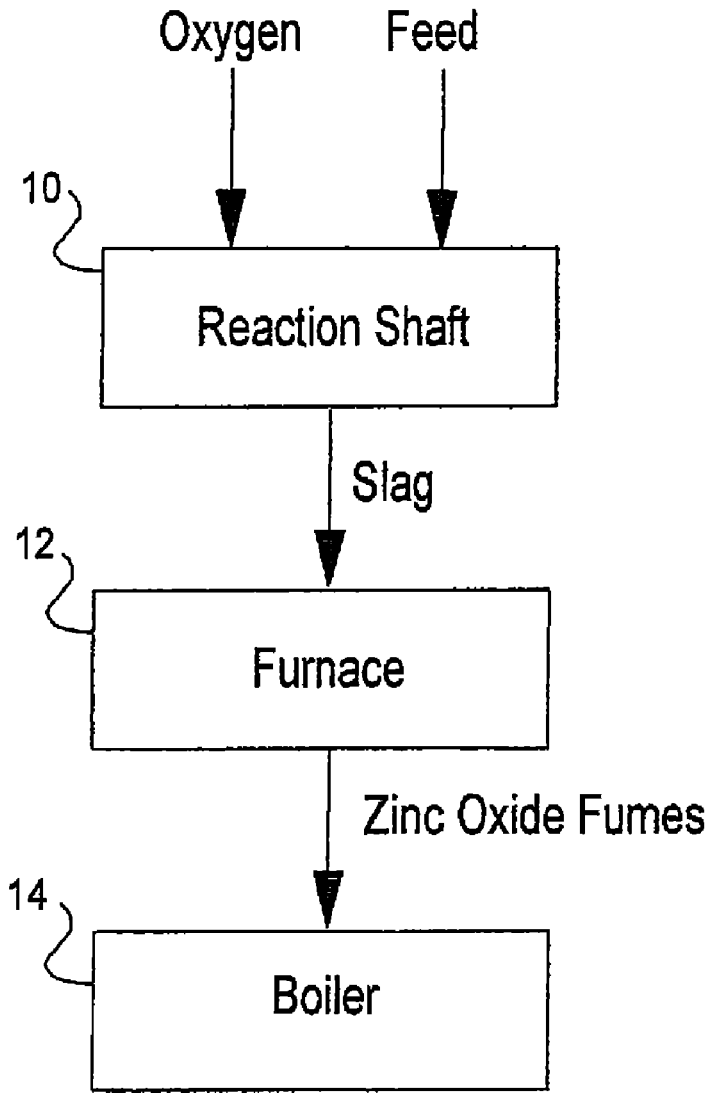
FIG. 1 is a perspective view of a flash smelter showing some of the process steps.
Figure 2:
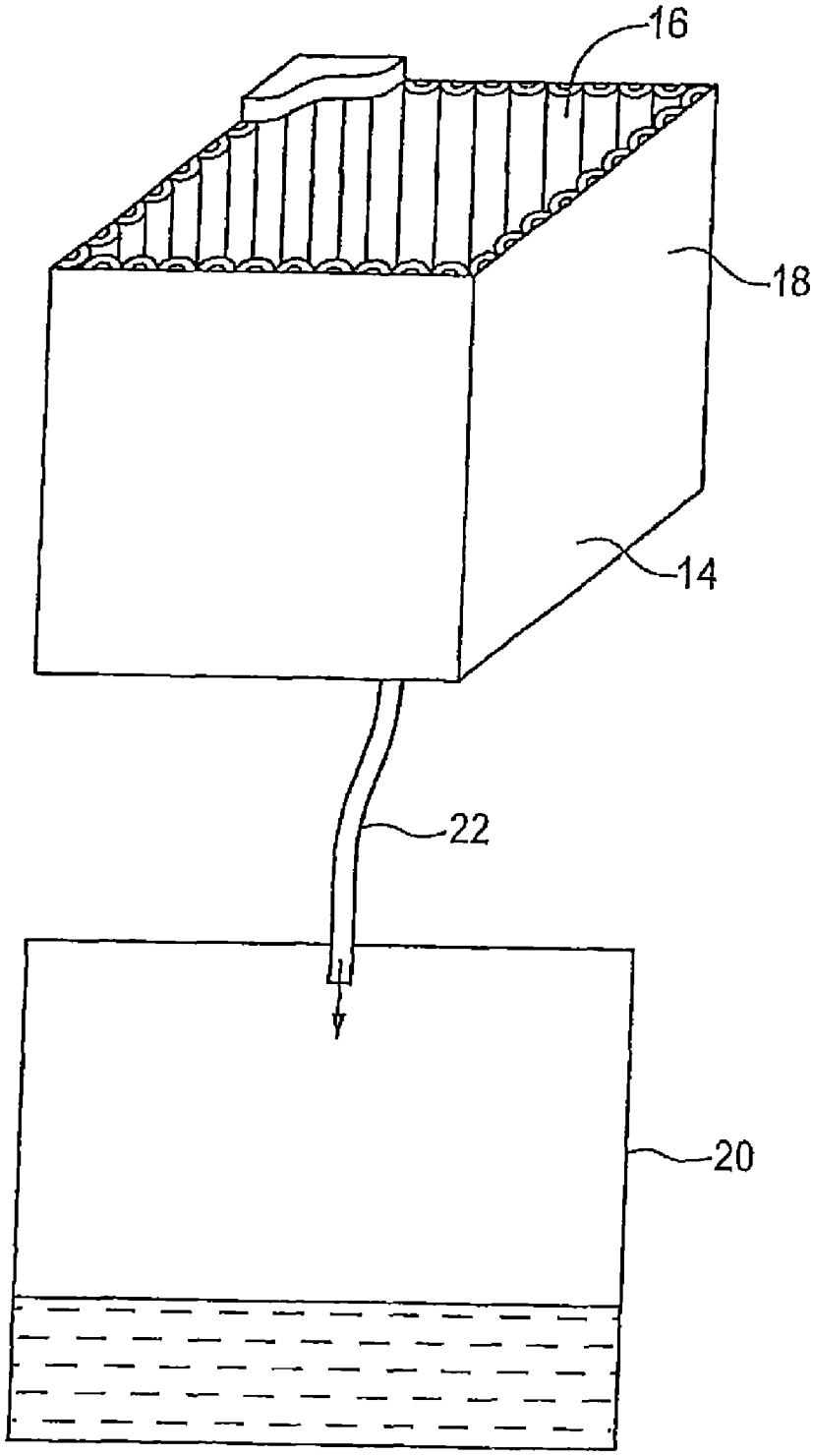
FIG. 2 is a perspective view of the waste boiler with the room cut away.

As shown in FIG. 2. in preparation for cleaning the waste boiler 14, a waste storage tank 20 is coupled to the waste boiler 14 by means of a drain line 22 which couples the bottom of the waste boiler 14 to the top of the waste tank 20. Any fluid running down the walls of the tubes 16 flows into drain line 22 and into waste storage tank 20.

Figure 3:
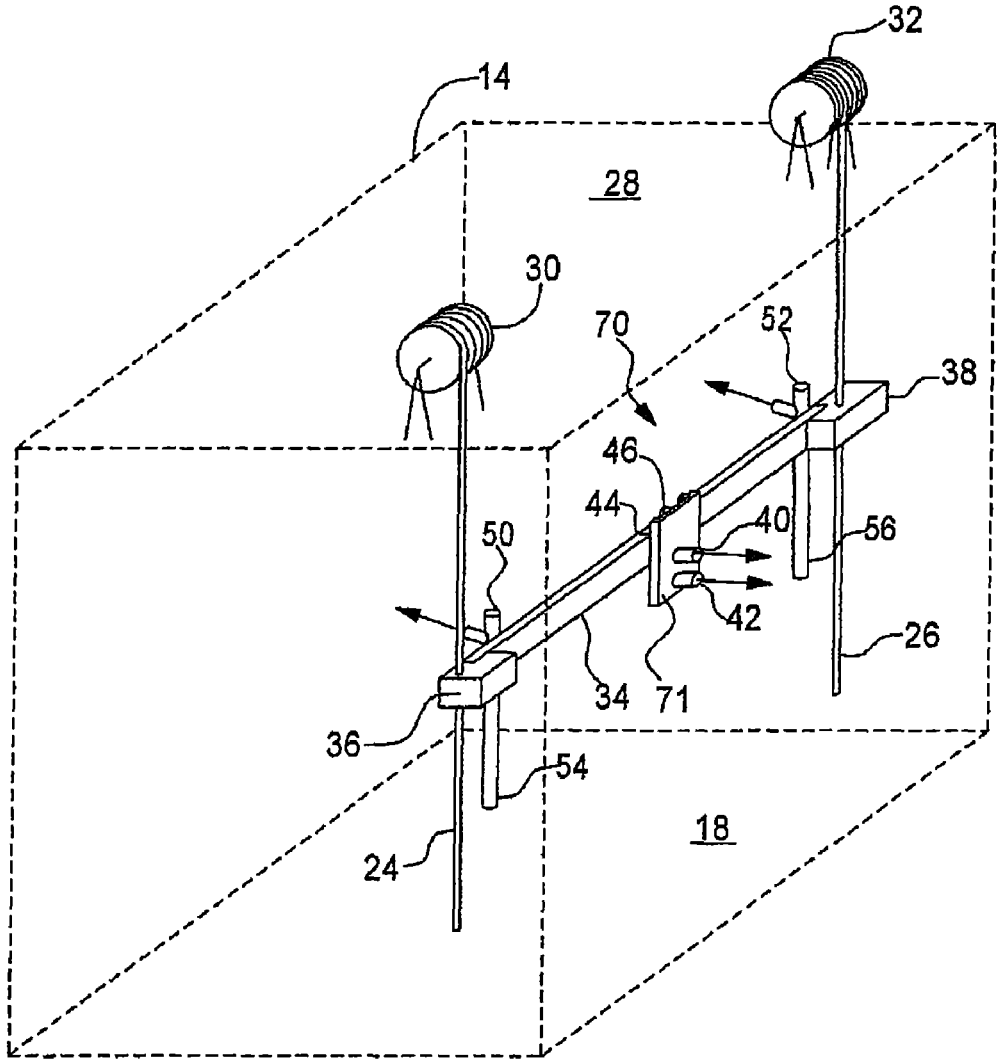
FIG. 3 is a perspective view of a portion of cleaning robot which cleans the outer surface of the heat exchanging pipes.

Once the waste storage tank 20 has been connected, the cleaning robot is set up as seen in FIG. 3. In this case two cables 24 and 26 are wound around respective drums 30 and 32 mounted on the roof 28. The cables hang down through the roof 28 adjacent the surface to be cleaned 18. Robot 70 comprises a rail 34 that extends from one side of the surface to the other and is affixed to a pair of mounting blocks 36 and 38 located at either end of rail 34.

A carriage 44 consisting of a mounting plate and three rail engaging wheels 46 moves from one side of rail 34 to the other, powered by a motor (not shown). Mounted on a mounting plate 71 are two vertically spaced apart nozzles 40 and 42. Two separate water pressure systems are coupled to nozzles 40 and 42. A 20,000 psi source of water is coupled to nozzle 40 and a 40,000 psi line is coupled to nozzle 42. In order to simplify the drawing no hoses or electrical components have been shown.

Drums 30 and 32 each have motors with remotely operated controllers coupled to a user control (not shown). By rotating drums 30 and 32 in the appropriate direction the robot 70 can be raised or lowered along the surface. A fixed connection to cables 24 and 26 can be replaced with a remotely controlled cable gripping gear system that allows the rail 34 to crawl up and down cables 24 and 26.

One or more ancillary water hoses 54 and 56 are attached to the robot 70, preferably at blocks 36 and 38, respectively. The ancillary water hoses have push nozzles 50 and 52 that emit jets of water in the opposite direction from the surface 18. When high pressure water is forced through the push nozzles 50 and 52, the momentum of the water emitted from nozzles 40 and 42 is counteracted to prevent the robot from being moved away from the surface.

Figure 5:
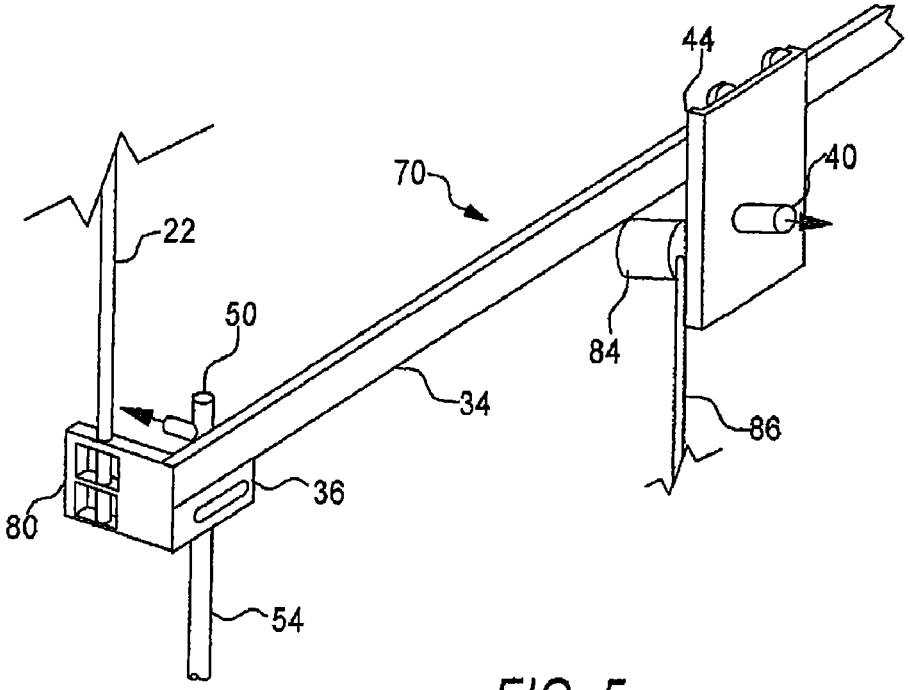

FIG. 5 shows an end of a robot of the invention in greater detail. In this embodiment the robot is positioned against the surface 18 by being suspended from cables, one of which is designated 22. The cable is attached by attachment plate 80 attached to an end block 18 of the rail 34. Push nozzle 50 is also connected to the end block. Ancillary water hose 54 connects to push nozzle 50 and is in communication with a source of pressurized water. Carriage 44 is shown with nozzle 40 attached thereto, the carriage being adapted to move to and fro along rail 34 by means of drive mechanism 84, which receives power from conduit 86.

In operation, using the embodiment shown in FIG. 3 for illustration, the robot 70 is raised or lowered into position by rotation of drums 30 and 32. Pressurized water is applied to nozzles 40 and 42. Initially high-pressure water (20,000 psi) is applied to nozzle 40 and ultra high pressure (40,000 psi) is applied to nozzle 42. Carriage 44 with its nozzles 40 and 42 are moved horizontially across the surface for a first pass, thereby producing a horizontal swath of cleaned surface. After the first pass of the nozzle 40, the rail is moved down a few inches and ultra high pressure is applied to nozzle 42 as well as high pressure to nozzle 40. The rail 34 is lowered by rotating drums 30 and 32 sufficiently to attain a next position below the first swath. The nozzles 40 and 42 again travel horizontally across the surface 18 cleaning additional swaths. This incremental vertical displacement of the rail followed by horizontal displacement of the nozzles is repeated until the entire surface 18 has been cleaned.

As shown in FIG. 2, waste water and removed materials drop to the floor and flow to waste tube 22 and, then, to the waste storage tank 20.

When one surface has been cleaned, the room is dried and the cleaned apparatus moved to an adjacent surface and the process is repeated, until all four surfaces have been cleaned. It is possible to start at a bottom of a wall and progress upwardly but all of the removed material would drop down on the rail and other parts of the cleaned apparatus. It is also possible to operate two or more rail assemblies 35 on two or more surfaces at the same time to speed up the cleaning process. The purpose of the ultra high pressure being applied to nozzle 42, is to smoothen out the surface and to blow away any residue left on the surface by operation of nozzle 40.

Figure 4:
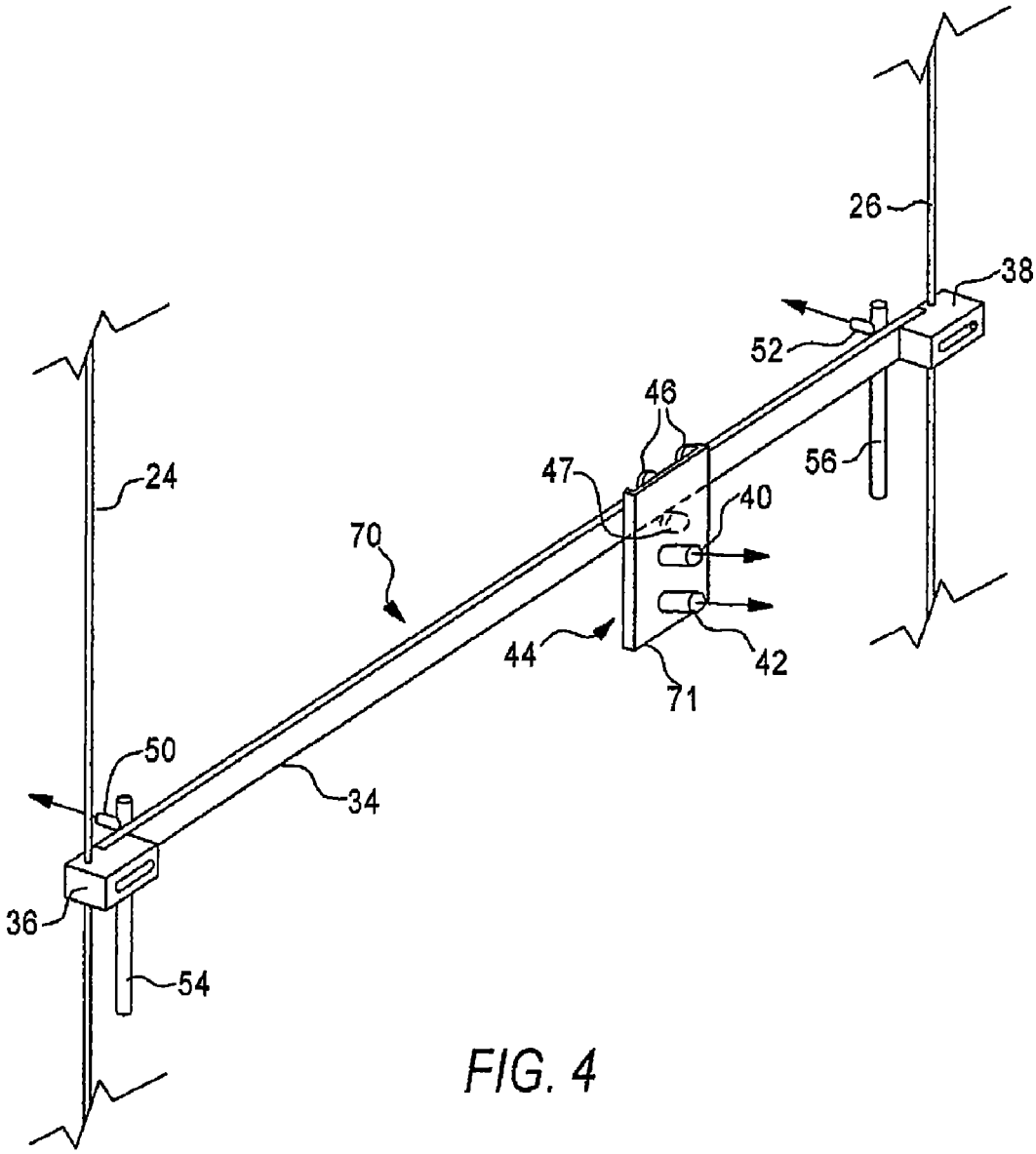
FIG. 4 is a perspective view of the cleaning robot attached to cables in a manner that permits the robot to crawl up and down the cables FIG. 5. is a perspective view an end of the apparatus in which the rail is attached to cables suspended from cables passing through the roof and wound around respective winches.

Referring to FIG. 4, the robot 70 is shown in more detail in an embodiment in which the robot crawls up and down the cables 24 and 26. In this case the carriage 44 has two wheels 46 which provide vertical support to the carriage and a horizontally disposed wheel (not shown) which engages an opposite side of the rail to maintain alignment of the carriage 44. Blocks 36 and 38 engage cables 24 and 26 and have a gear system which allows progressive vertical movement of the rail 34 along cables 24 and 26. Rather than moving the rail vertically incrementally and stopping for each swath, one can also run the rail so it rises continuously and the nozzles 40 and 42 move without stopping, from one side of the rail to the other.

While the method has described sequential cleaning of adjacent surfaces, as mentioned above, it is possible to clean more than one surface at a time by employing multiple robots simultaneously. Ancillary water lines 54 and 56 and associated push nozzles 50 and 52 provide a rearwardly thrust that counteracts the thrust from the water emitted from nozzles 40 and 42.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

We claim:

1. An apparatus for cleaning a substantially vertical surface, said apparatus comprising:

a. a pair of cables suspended adjacent the surface;

b. a robot comprising:

i. a rail having a first end and a second end, wherein said first and said second ends are connected to respective ones of said cables and wherein said robot is movably suspended on said pair of cables to move up and down the surface;

ii. a carriage movably attached to said rail to move back and forth along the length of said rail;

iii. a first nozzle carried by said carriage, said first nozzle being connected to a source of high pressure or ultra high pressure fluid and said first nozzle being operative to emit a jet of fluid against the surface; and, iv. a push nozzle supported on said rail, said push nozzle being connected to a source of high pressure or ultra high pressure fluid and being operative to emit a jet of water in the opposite direction of the surface.

2. The apparatus of claim 1 wherein said carriage comprises wheels for moving said carriage back and forth along said rail.

3. The apparatus of claim 1 wherein said robot further comprises a gear mechanism for causing said robot to crawl up and down said cables.

4. The apparatus of claim 1 further comprising drums about which said cables are wound, wherein rotation of said drums causes said robot to be raised and lowered.

5. A method of cleaning a substantially vertical surface using the apparatus of claim 1, said method comprising the steps of:

(a) mounting the robot adjacent the surface;

(b) applying the high pressure or ultra-high pressure fluid to the first nozzle;

(c) directing the fluid of Step (b) against the surface, whereby a momentum is produced directed away from the surface;

(d) applying the high or ultra-high pressure fluid to the push nozzle, whereby thrust produced by the push nozzle counteracts the momentum produced at Step (c);

(e) moving the first nozzle over the surface, whereby a swath of the surface is cleaned; and, (f) repeating Steps (c) through (e) until the surface has been substantially cleaned.

6. The method of claim 5, wherein step (a) includes:

(a1) suspending the pair of cables adjacent the surface;

(a2) attaching the first end of the rail to one of the cables of step (a1); and, (a3) attaching the second end of the rail to another of the cables of step (a1), and wherein Step (e) comprises at least one of i) moving the robot up and down the surface, and ii) moving the carriage back and forth along the rail.

* * * * *